US006715225B1

(12) United States Patent
Frolov et al.

(10) Patent No.: US 6,715,225 B1
(45) Date of Patent: Apr. 6, 2004

(54) ILLUMINATED EXIT BAR

(75) Inventors: George Frolov, Farmington, CT (US); Alfred S. Levesque, Newington, CT (US); Victor Bogdanov, Manchester, CT (US); David C. DeBiase, Wallingford, CT (US); Michael Brown, Plantsville, CT (US)

(73) Assignee: Harrow Products, Inc, Woodcliff Lake, NJ (US)

( * ) Notice: Subject to any disclaimer, the term of this patent is extended or adjusted under 35 U.S.C. 154(b) by 10 days.

(21) Appl. No.: 10/053,413

(22) Filed: Nov. 9, 2001

(51) Int. Cl.[7] ..... G09F 13/04

(52) U.S. Cl. ..... 40/570; 40/464; 292/93; 292/336.3

(58) Field of Search ..... 40/442, 452, 570, 40/580, 464; 292/92, 93, 336.3; 362/100, 800, 812, 802; 340/815.45, 815.48; 345/46, 82, 173; 446/175

(56) References Cited

U.S. PATENT DOCUMENTS

| | | | | | |
|---|---|---|---|---|---|
| 1,306,560 | A | * | 6/1919 | Page | 292/335 |
| 1,704,748 | A | * | 3/1929 | Kusch | 292/93 |
| 1,898,505 | A | * | 2/1933 | Soemer | 292/92 |
| 2,732,237 | A | * | 1/1956 | Kihn et al. | 292/67 |
| 3,570,158 | A | * | 3/1971 | Hackett | 40/452 |
| 3,777,222 | A | * | 12/1973 | Harris | 341/26 |
| 4,710,634 | A | | 12/1987 | Brookes | |
| 4,871,204 | A | * | 10/1989 | Cook et al. | 292/251.5 |
| D322,550 | S | | 12/1991 | Evans | |
| 5,398,175 | A | | 3/1995 | Pea | |
| 5,513,454 | A | * | 5/1996 | Kao et al. | 40/714 |
| 5,581,230 | A | | 12/1996 | Barrett | |
| 5,638,052 | A | * | 6/1997 | Furuya et al. | 340/815.45 |
| 5,973,607 | A | * | 10/1999 | Munyon | 340/815.4 |
| 5,988,708 | A | * | 11/1999 | Frolov et al. | 292/92 |
| 6,135,621 | A | | 10/2000 | Bach et al. | |
| 6,222,455 | B1 | | 4/2001 | Kaiser | |

* cited by examiner

*Primary Examiner*—Brian K. Green
(74) *Attorney, Agent, or Firm*—Michael Best & Friedrich LLP

(57) ABSTRACT

An illuminated exit bar incorporates a light source within the elongated space defined between a door-mounted housing and a push bar. The push bar defines an elongated opening for light generated within the exit bar. An exit plate covers the push bar opening and defines light transmissive openings in the form of exit instructions. An exit insert of light transmissive material is configured to be complementary to the exit plate. Light is gathered from within the exit plate and conducted to the push face of the exit bar to provide illuminated words and/or symbolic instructions for egress. The illuminated light bar is configurable for installation on left or right hand opening doors by electrically altering the pattern of internal illumination and assembling some parts in alternative configurations. The illuminated exit bar is compatible with electronic building security systems. The pattern of illuminated instructions can be remotely altered to reflect changed security conditions.

20 Claims, 6 Drawing Sheets

ILLUMINATED EXIT BAR

BACKGROUND OF THE INVENTION

1. Field of the Invention

This invention relates to the field of push bars or exit bars which allow egress through a doorway. More particularly, this invention relates to an illuminated exit bar.

2. Description of the Related Art

Push bars or exit bars which allow egress through a doorway while limiting ingress are well known components of door security and emergency systems. The conventional exit bar is mounted on the inside of the door to be secured and is oriented generally horizontally across the face of the door. A push force on the bar toward the door face actuates a door release mechanism to permit opening of the door. Conventional exit bars typically employ a mechanical linkage to actuate a latch mechanism for unlatching the door. In security systems employing electromagnetic locks, the release mechanism is typically some form of electric switch which, when actuated, removes or applies electric current to the electromagnetic lock.

Exit bars may be integrated with security and fire alarm systems. Integration typically involves providing each exit bar with electronic or electromechanical actuation means responsive to the fire alarm and/or security system that permit remote locking or unlocking of doors equipped with the exit bar. Such an electromagnetic latch retractor for an exit bar is described in U.S. Pat. No. 6,104,594, assigned to the assignee of the present invention.

Building and fire codes typically require facilities frequented by the public to be equipped with emergency lighting and exit signs which provide light and directional indications in emergency situations when building electricity may be cut off. In many non-emergency situations room lighting may be dimmed for any number of reasons, making it difficult for persons attempting egress through a doorway equipped with an exit bar to determine the exact position of the exit bar and/or the opening direction of the door. Accordingly, there is a need in the art for an exit bar that provides visual and directional aids that are visible under all lighting conditions.

SUMMARY OF THE INVENTION

Briefly stated, the invention in a preferred form is an exit bar provided with a light emitting push pad. Several arrays of light sources are mounted within the exit bar housing to emit light through light transmissive portions of the push pad. In one preferred embodiment, the light transmissive portions of the push pad are configured in the form of written instructions such as "PUSH TO EXIT". In accordance with another feature of the present invention, the light transmissive portions of the push bar are color coded by the use of colored light transmissive material in the push pad or colored light sources internal to the exit bar. Another aspect of the present invention permits the light source to change the pattern and color of illumination to indicate an altered security state for the doorway.

More particularly, the exit bar includes housing which is mounted generally horizontally across the interior face of a door. A push bar is supported in the housing for reciprocal movement toward and away from the face of the door. The push bar supports a push pad that defines an exposed push face for receiving a push force. A link system supports the push bar relative to the housing while springs bias the push bar away from the door. A push force applied to the push pad moves the push bar toward the door and releases a latch device to unlatch the door. The latch device may be a mechanical latch and linkage, electromechanical, e.g., servo-controlled or simply a switch.

The present invention will be described in the context of an exit bar configured for use in conjunction with a doorway equipped with an electric or electromagnetic lock releasable by an electronic signal. Those of skill in the art will recognize that such an exit bar does not include a latch mechanism mechanically linked to the push bar. However, the principles of the invention are equally applicable to all types of exit bars.

In accordance with the present invention, the push bar defines an opening covered by the push pad, which in turn includes light transmissive portions positioned over the opening. Light sources are arranged inside the exit bar to radiate light through the light transmissive portions of the push pad to provide an illuminated push face for the exit bar.

In accordance with one particular aspect of the invention, the array of light sources comprises arranged a plurality of light emitting diodes (LEDs) arranged on a printed circuit (PC) board. A second PC board carries a switch. The switch and its associated PC board are supported such that a push force exerted on the push pad actuates the switch. The switch serves as the actuation device by sending a signal to the building security system to release the electromagnetic lock for the doorway.

In accordance with another aspect of the present invention, more than one group of LEDs are arranged on the PC board in a pattern which will illuminate all or a portion of the exit instructions defined by the light transmissive portions of the push pad. Under normal circumstances, the entire message, e.g., "PUSH TO EXIT", will be illuminated. Under other circumstances, such as when the push bar is depressed or the building security system has released the locks on the exit door, an alternative set of LEDs will illuminate only, e.g., the word "EXIT". The alternative patterns of LEDs may be of alternative color. For example, the array of LEDs which illuminates the full exit instructions may be red while the alternative array of LEDs which illuminates only a portion of the exit instructions may be green. The exit instructions and colors discussed herein are exemplary and it will be understood that other instructions and colors and patterns of illumination are within the scope of the present invention.

In accordance with a further aspect of the present invention, the exit bar has a reversible configuration for use on a left hand or right hand opening door. The housing and push bar are uniform extrusions. The LED arrays include alternative patterns that are electrically configurable for left hand or right hand operation. The push pad is installed adjacent the opening side of the door.

An object of the present invention is to provide a new and improved exit bar having improved visibility in low light conditions.

Another object of the present invention is to provide a new and improved exit bar with illuminated exit instructions that can be remotely altered to reflect changed building security conditions.

A further object of the present invention is to provide a new and improved exit bar with illuminated exit instructions that is reconfigurable for a left or right hand opening doorway.

These and other objects, features and advantages of the invention will become readily apparent to those skilled in the art upon reading the description of the preferred embodiments, in conjunction with the accompanying drawings.

DETAILED DESCRIPTION OF THE PREFERRED EMBODIMENT

Figure 1:
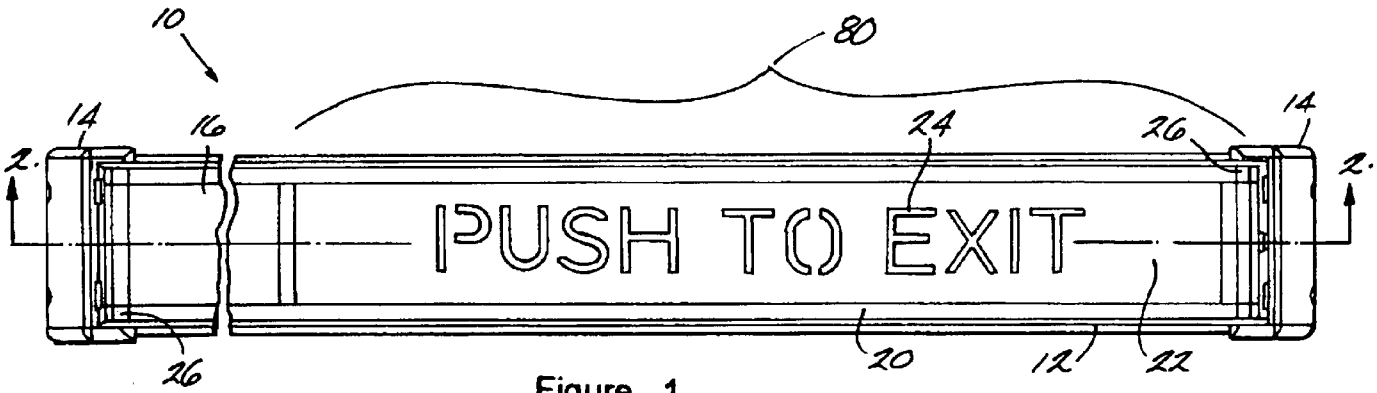
FIG. 1 is a front exterior view, partly broken away, of an illuminated exit bar in accordance with the present invention.
Figures 4, 5, 6:
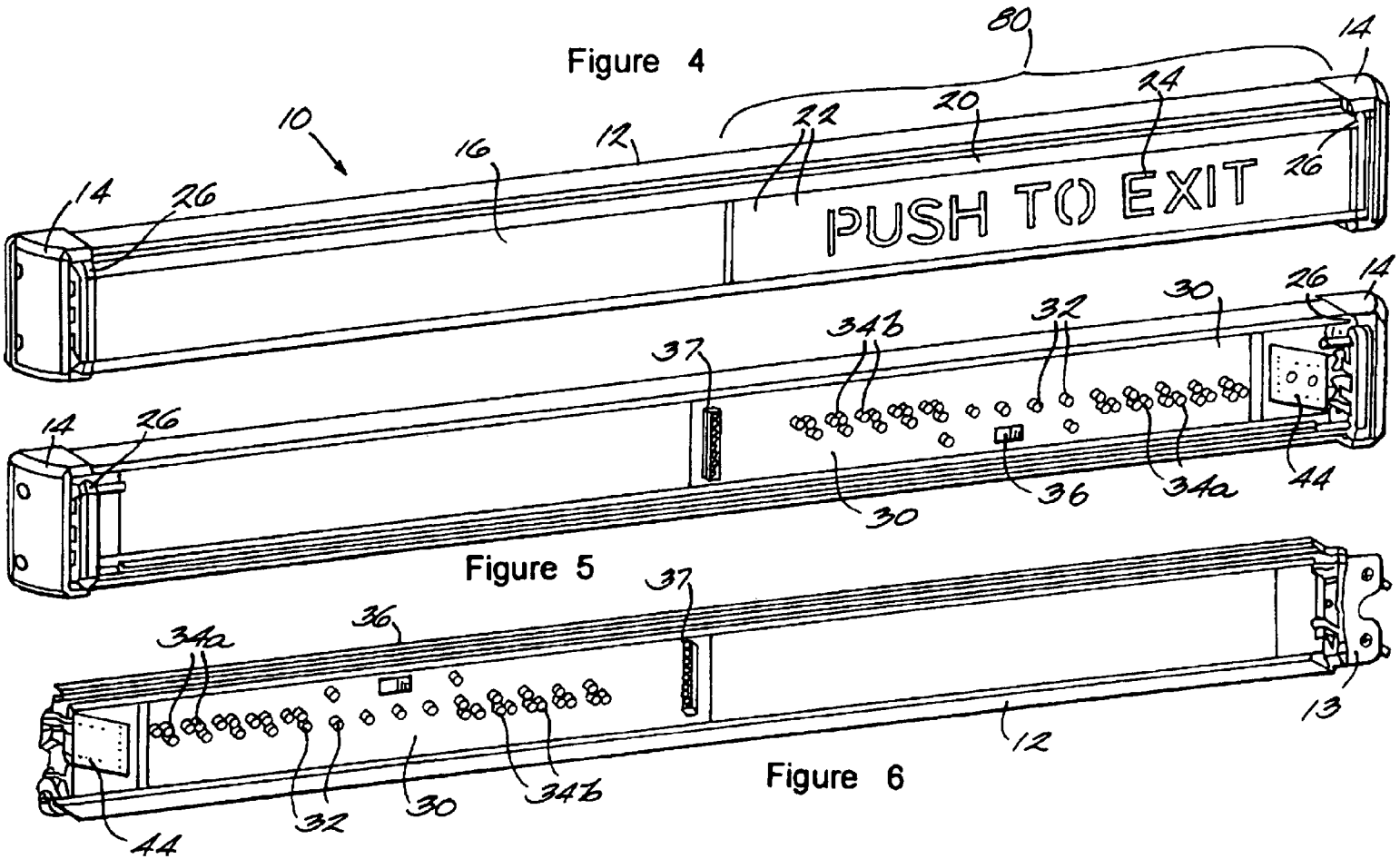
FIG. 4 is a perspective view of the illuminated exit bar shown in FIG. 1.
FIG. 5 shows the exit bar of FIG. 4 with the push bar removed.
FIG. 6 shows the exit bar of FIG. 4 with the end blocks, push bar and end caps removed and shown in a reversed position.

With reference to the drawings, in which like numerals indicate like parts throughout the several Figures, a preferred embodiment of an illuminated exit bar in accordance with the present invention is generally designated by the numeral 10. FIGS. 1 and 4 show an illuminated exit bar 10 as it would appear to a person attempting egress through a door equipped with the exit bar. The illuminated exit bar 10 is configured to be mounted in a horizontal position across the interior face of a door (not illustrated). The illuminated exit bar 10 has a length that is preferably sufficiently long to substantially span the width of the door. Generally speaking, the door will have a hinge edge and an opening edge. The terms "hinge edge" and "opening edge" will be understood to refer to that end of the item being discussed that is directed toward the corresponding edge of the door.

Figure 7:
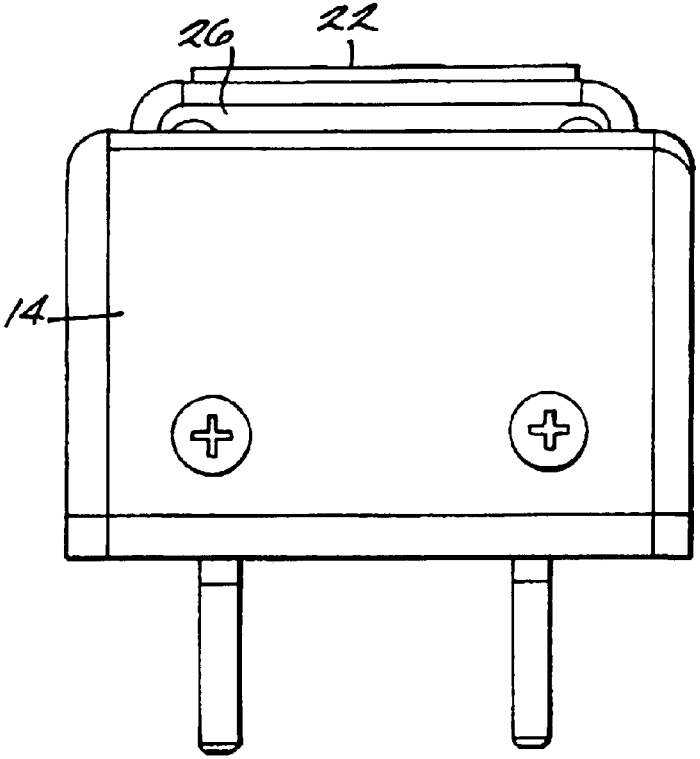
FIG. 7 is an enlarged exterior view of the left end of the illuminated exit bar shown in FIG. 1.
Figure 9:
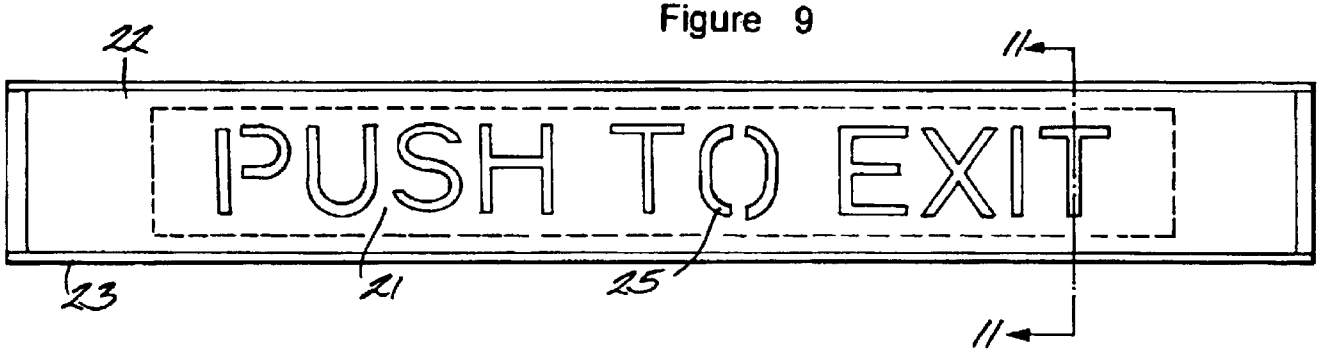
FIG. 9 is a schematic view of an exit plate, partially in phantom, suitable for use in conjunction with the illuminated exit bar of FIG. 1.
Figure 10:
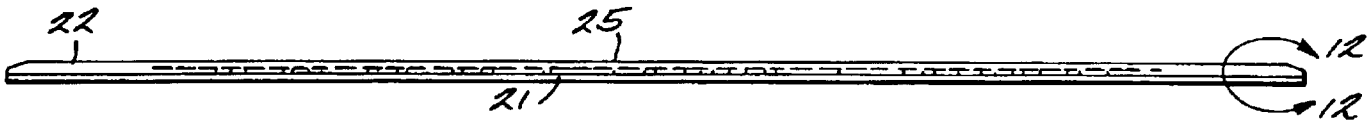
FIG. 10 is a longitudinal side view, partially in phantom, of the exit plate shown in FIG. 9.
Figure 12:
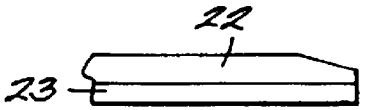
FIG. 12 is an enlarged view of the right end portion of the exit plate contained within line 12—12 of FIG. 10.
Figure 11:
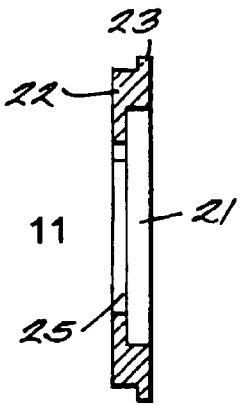
FIG. 11 is a sectional view through the exit plate shown in FIG. 9 taken along line 11—11 thereof.

The illuminated exit bar 10 includes a longitudinally extending housing 12 mountable to the door by means of end brackets 13 and fasteners. A preferred embodiment of the housing 12 employs an extrusion which defines longitudinally extending features configured to support or interact with other components of the illuminated exit bar 10. Fastener receptacles defined by the housing extrusion receive fasteners passing through a molded end block 14 as shown in FIG. 7. The end blocks 14 provide a finished appearance to the ends of the assembled illuminated light bar 10.

Figure 3A:
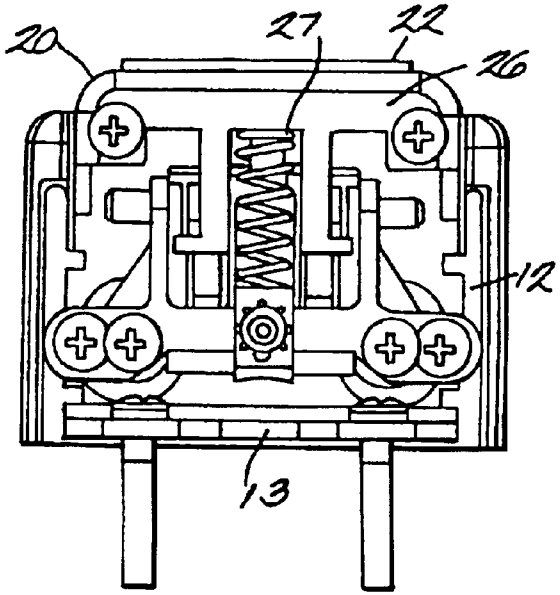
FIG. 3*a* is a right-end view of the illuminated exit bar shown in FIG. 1 with the end block removed.
Figure 3:
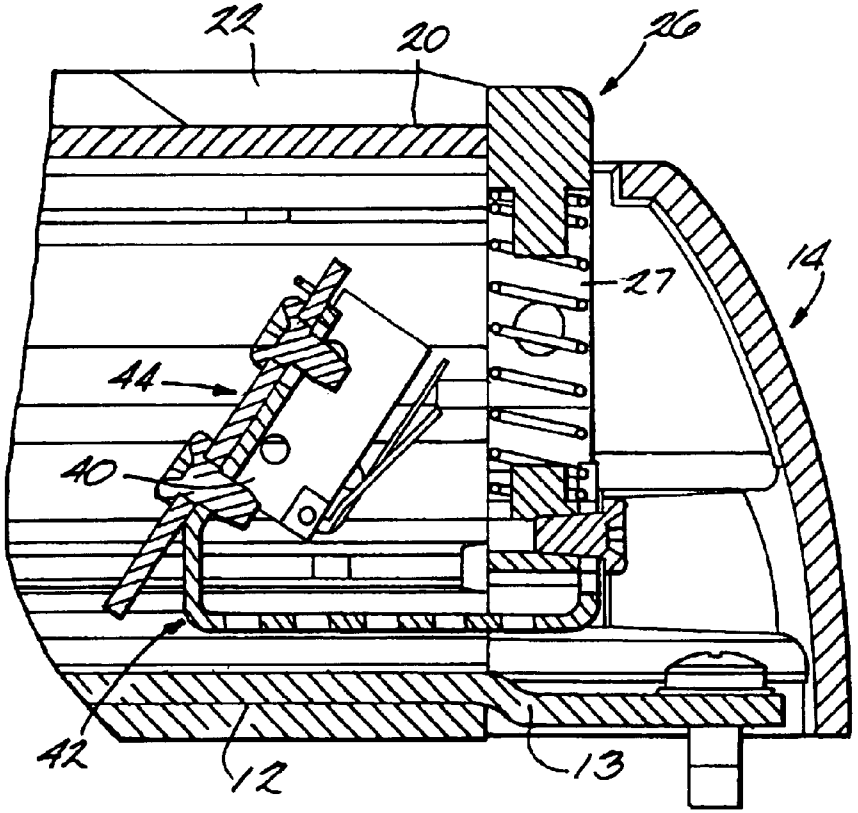
FIG. 3 is an enlarged view of the right end of the illuminated exit bar contained within line 3—3 of FIG. 2.
Figure 8:
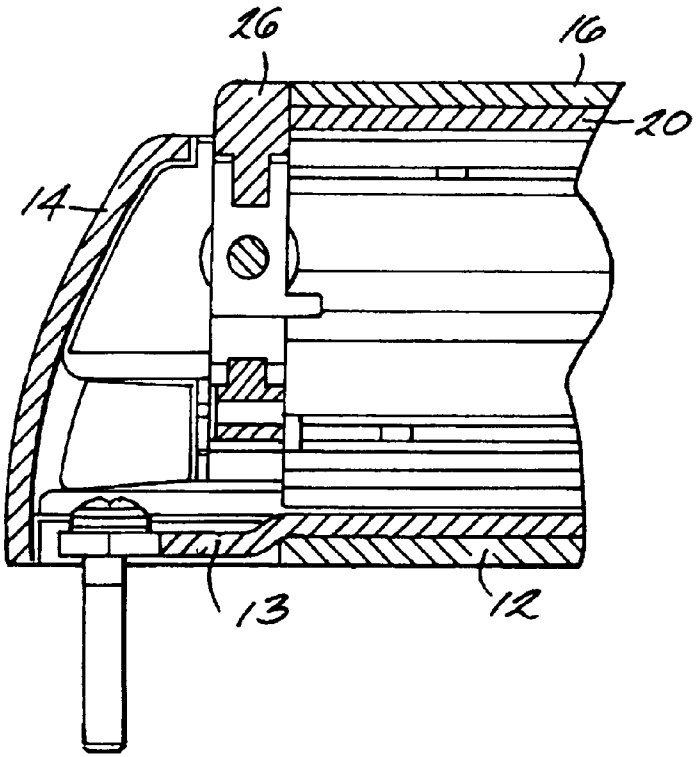
FIG. 8 is an enlarged view of the left end of the illuminated exit bar contained within line 8—8 of FIG. 2.

A push bar 20 is supported for reciprocal movement relative to the housing 12. A preferred embodiment of the push bar 20 comprises a longitudinally extending extrusion (see FIG. 3A) configured for reception between the outer longitudinal walls 11 of the housing 12. Fasteners pass through end caps 26 to engage fastener receptacles defined by the extruded push bar 20. As best seen in FIGS. 3, 3A and 8, the end caps 26 connect the push bar 20 to the longitudinally spaced linkages that support the push bar 20 for reciprocal movement relative to the housing 12. A spring 27 biases the push bar 20 toward a position projecting from the housing 12.

The push bar also defines a longitudinally extending, outward facing channel 45 that receives and retains components defining a push face 80 for receiving a push force. Legs 47 on the push bar extrusion project generally perpendicular to the push face 80 and provide structural rigidity to the push bar. The legs 47 also define the limit of inward movement of the push bar relative to the housing by contacting shoulders 17 projecting inwardly from the longitudinal walls 11 of the housing 12. A longitudinally extended opening 53 in the push bar extrusion central web 54 permits light generated inside the illuminated exit bar to pass outwardly through the components defining the push face 80.

In the illustrated preferred embodiment the push face 80 of the illuminated exit bar 10 is defined by an exit plate 22 which receives an exit insert 24. The exit plate 22 includes longitudinal lips 23 that are received in the channel 45 of the push bar 20. Depending on whether the illuminated exit bar is configured for a left or right-hand opening door, the exit plate 22 and received exit insert 24 will be installed adjacent the left or right ends, respectively, of the push bar 20. FIGS. 1 and 4 illustrate an illuminated exit bar 10 configured for a right-hand opening door, for example. A dress plate 16 abuts the hinge end of the exit plate 22 to cover the longitudinally extending opening 53 in the push bar 20 and present a finished appearance for the face of the assembled illuminated light bar 10.

Figure 14:
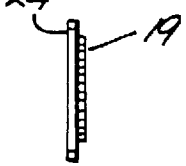
FIG. 14 is an end view of the exit insert shown in FIG. 13.
Figure 13:
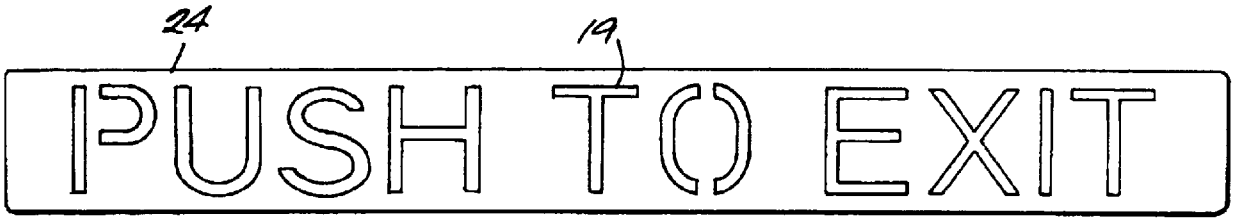
FIG. 13 is a schematic view of an exit insert for use in conjunction with the exit plate of FIGS. 9–12.

The configuration of the exit plate 22 is best illustrated in FIGS. 9–12. A preferred embodiment of the exit plate 12 is molded from plastic such as ABS plastic. The molded exit plate 12 defines a generally rectangular pocket 21 facing the interior of the exit bar. In the illustrated embodiment, openings 25 spelling "PUSH TO EXIT" extend between the pocket and the push face 80 of the exit plate 22. The laterally opposed ends of the exit plate taper to meet the end cap 26 and dress plate 16. The pocket 21 and openings 25 spelling "PUSH TO EXIT" defined by the exit plate 22 are configured to closely receive an exit insert 24 as illustrated FIGS. 13 and 14.

A preferred embodiment of the exit insert 24 is molded from light transmissive plastic material such as ABS plastic. The body of the exit insert 24 is configured to correspond to the pocket 21 defined in the exit plate 22. Raised letters 19 spelling "PUSH TO EXIT" project from one side of the exit insert 24 complementary to the openings 25 through the exit plate 22. The exit insert 24 is inserted into the pocket 21 of the exit plate 22. When so assembled, the raised letters 19 projecting from the exit insert 24 substantially fill the openings 25 through the push face 80 of the exit plate 22.

The light transmissive properties of the exit insert 24 serve to collect light generated inside the illuminated exit bar 10 and conduct it to the push face 80. The assembled exit plate 22 and exit insert 24 are inserted into the push bar channel 45 with the lips 23 on the exit plate 22 engaged under complementary lips of the push bar channel 45. A dress plate 16 configured to fill the space between a hinge end of the exit plate 22 and the end cap 26 is then inserted to complete the appearance of the push face 80. Fasteners through each end cap 26 engage the fastener receptacles in the push bar 20 to trap the exit plate 22 and dress plate 16 in their assembled configuration.

In accordance with one feature of the preferred embodiment, the illuminated exit bar 10 is configured to be compatible with both left and right-hand opening doors. FIG. 4 illustrates an illuminated exit bar 10 configured for use with a right-hand opening door. In a right-hand opening configuration the exit plate 22 is arranged adjacent the side of the exit bar where the door will open, e.g., the right end. With the push bar 20 removed in FIG. 5, it can be seen that the PC board 30 with a plurality of LEDs 32, 34*a*, 34*b* is arranged in a position behind the exit plate 22 of FIG. 4. Light emitted by the LEDs is collected by the exit insert 24 and transmitted to the push face 80 to illuminate the exit instructions "PUSH TO EXIT".

Three parallel arrays of LEDs are fixed to the PC board 30. The first array 32 is arranged generally on the longitudinal median of the PC board and extends the length of the exit instructions. Second and third shorter arrays 34*a*, 34*b* are arranged above and below portions of the first LED array 32. A switch 40 permits routing of power to either the second or third shorter arrays 34*a*, 34*b*. For the embodiment of FIGS. 4 and 5, the switch is shown in a right-hand configuration that will route energy to the short LED array 34*a* behind the word "EXIT".

Under normal building security conditions, the door to which the illuminated exit bar 10 is fixed will be latched until released by a push force applied to the push face 80 of the push bar 20. Under such normal building security conditions, the extended first LED array 32 will be provided with energy to illuminate the entire exit instructions "PUSH TO EXIT". Upon pushing the push bar 20, switch 40 actuates to reroute power from the extended LED array 32 to shorter arrays 34*a* or 34*b* to illuminate only the word "EXIT". On some occasions, such as an emergency or the end of a large gathering, the exit doors may be released. Signals are transmitted by the building security system to apply energizing power only the second or third LED array 34*a*, 34*b* behind the word "EXIT", with the first array 32 being extinguished. Only the word "EXIT" will be illuminated at the end of the exit plate designating the opening direction of the door. Thus, instructions to pedestrians approaching the exit door can be tailored to meet circumstances.

FIG. 6 illustrates the illuminated exit bar 10 with the push bar 20, end caps 14 and end blocks 26 removed and rotated 180° for installation on a left-hand opening door. The PC board 30 is adjacent the left-hand or opening end of the housing 12. The housing 12 and push bar 20 are extrusions that have a generally uniform transverse cross section. The exit plate 22 and its associated exit insert 24 are installed in the left-hand end of the push bar channel 45 over the PC board-mounted LED arrays 32, 34*a*, 34*b*.

The position of the hand-select switch 36 is reversed to provide energy to the short array of LEDs 34*b* now arranged behind the word "EXIT". This array 34*b* was formerly in the upper left of the PC board as seen in FIG. 5. Thus, to configure the illuminated exit bar 10 for installation on a left-hand opening door, the installation of the exit bar housing is reversed, the location of the slide switch is reversed, and the exit plate is inserted in the left-hand end of the push bar channel 45.

Figure 2:
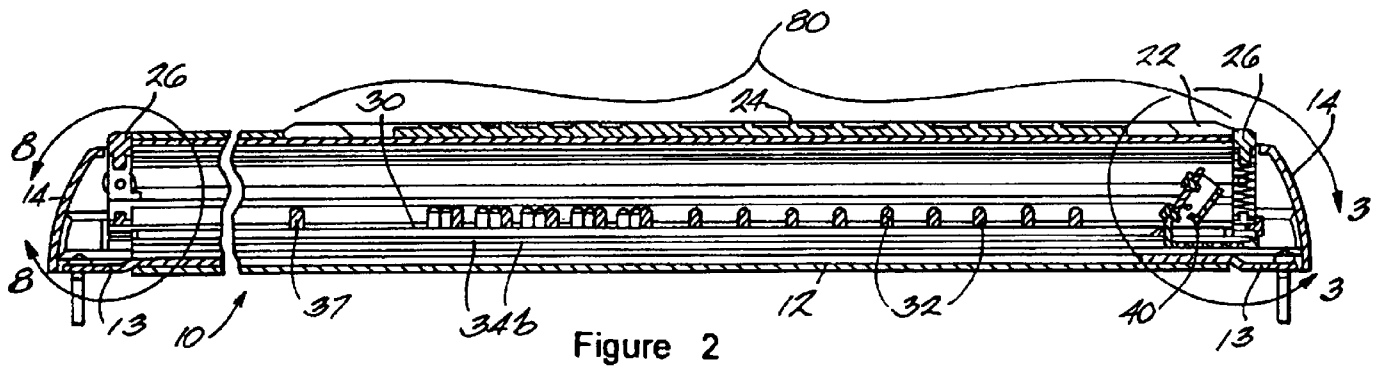
FIG. 2 is a sectional view through the illuminated exit bar shown in FIG. 1 taken along the line 2—2 thereof.
Figure 15:
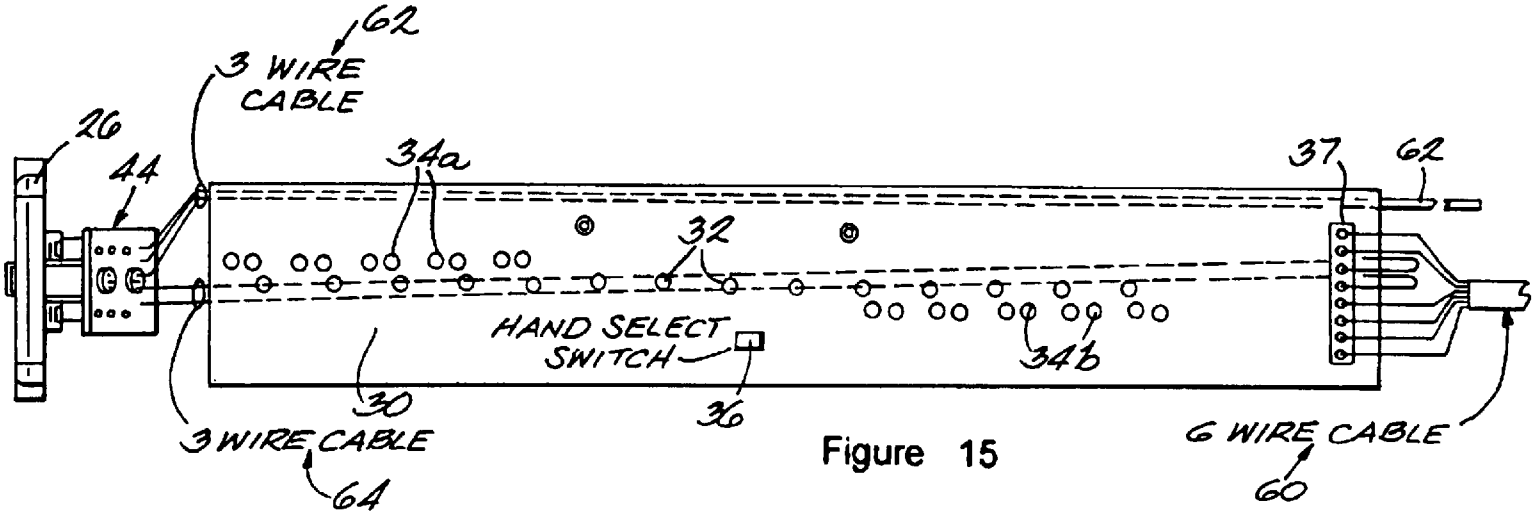
FIG. 15 is a wiring diagram for the illuminated exit bar of FIG. 1.

FIG. 15 illustrates the electrical wiring of the PC board 30 and associated actuation switch 40. Cables 60, 62 connect each exit bar to the building security system, bringing power to the illuminated exit bar and also receiving signals from the actuation switch 40. A cable connector 37 is arranged the hinge end of the PC board 30 for connecting to cable 60. With reference to FIGS. 2, 3 and 3A, a small PC board 44 carrying the actuation switch 40 is supported by a bracket 42. The bracket 42 holds the actuation switch 40 adjacent internal components of the exit bar such that when the push bar 20 is moved toward the door, the actuation switch 40 changes state. Actuation switch 40 functions to reroute power from the extended LED array 32 to the shorter array 34*a* or 34*b* to illuminate only the word "EXIT". The state of actuation switch 40 may also be monitored by the building security system through cables 60, 62. The building security system may communicate with the exit bar via the cables 60, 62 to change the illumination pattern of the PC board as described above. The security system may release the latch on the exit door or the actuation switch 40 may directly release the latch.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. An illuminated exit bar comprising:

an elongated housing mountable to a door;

a push bar defining a push face for receiving a push force, said push bar mounted for reciprocal movement relative to said housing;

a plurality of light sources; and switch means responsive to reciprocal movement of said push bar for altering delivery of power to said plurality of light sources;

wherein light produced by said plurality of light sources is emitted from said push face to form an illuminated pattern and said pattern changes upon actuation of said switch means in response to reciprocal movement of said push bar;

wherein said push bar defines a channel in which an exit plate and a dress plate are received, said push face comprising said exit plate.

2. An illuminated exit bar comprising:

an elongated housing mountable to a door;

an elongated push bar mounted for reciprocal movement relative to said housing between a first position away from said door to a second position toward said door and resiliently biased toward said first position;

illumination means for generating light; and door release means for releasing said door to permit egress in response to a push force applied to said push bar;

wherein light generated by said illumination means is emitted from said elongated push bar in a first pattern when said door is released in response to a push force applied to said push bar.

3. The illuminated exit bar of claim 1, wherein said housing defines an elongated internal space, said illumination means includes a plurality of light sources mounted within said internal space, and said elongated push bar includes a push face having at least one light transmissive portion and light produced by said plurality of light sources is conducted through said push bar by said at least one light transmissive portion.

4. The illuminated exit bar of claim 3, wherein said plurality of light sources comprise a plurality of LEDs.

5. The illuminated exit bar of claim 4, wherein said plurality of LEDs are mounted to a PC board which is in turn mounted at least partially within the elongated internal space defined by said housing and said push bar.

6. The illuminated exit bar of claim 5, wherein said plurality of LEDs comprises at least two alternatively energizable arrays of LEDs.

7. The illuminated exit bar of claim 5, wherein said plurality of LEDs comprises at least three arrays of LEDs, a first of said arrays being provided with power independently of a second and third of said arrays.

8. The illuminated exit bar of claim 7, wherein power is delivered alternatively to said second and third of said arrays, said alternative power delivery being controlled by means of said switch means.

9. The illuminated exit bar of claim 4, wherein said push bar defines a channel in which an exit plate and a dress plate are received, said plurality of LEDs comprises at least three arrays of LEDs, a first of said arrays being provided with power independently of a second and third of said arrays and power is delivered alternatively to said second and third of said arrays, said alternative power delivery being controlled by means of a switch means responsive to reciprocal movement of said push bar for altering delivery of power to said plurality of LEDs, said exit bar being configurable for use in conjunction with a left or right hand opening door by reversing the orientation of said housing relative to a door, changing a state of said switch and reversing the positions of said exit plate and dress plate in said channel.

10. The illuminated exit bar of claim 2, wherein said push bar defines a channel in which an exit plate and a dress plate are received.

11. The illuminated exit bar of claim 2, wherein said first pattern comprises the word "EXIT" and said first pattern changes to a second pattern comprising the words "PUSH TO EXIT" when no push force is applied to said push bar.

12. The illuminated exit bar of claim 2, wherein said illumination means comprises a plurality of LEDs mounted between said housing and said push bar and said push bar includes at least one light transmissive portion which gathers light generated by said LEDs and conducts said light to a push face defined by said push bar to provide said first and second patterns.

13. The illuminated exit bar of claim 2, wherein said at least one light transmissive portion comprises a plurality of light transmissive openings in said push face to provide said first and second patterns.

14. The illuminated exit bar of claim 13, wherein said plurality of light transmissive openings in said push face are in the form of words or symbols comprising instructions for egress through the door.

15. The illuminated exit bar of claim 2, wherein said door release means comprises a switch actuated by movement of said push bar from said first position to said second position.

16. The illuminated exit bar of claim 15, wherein said switch is operatively connected to a building security system responsive to a signal generated by said switch to release said door.

17. A reversible illuminated exit bar comprising:

a longitudinally extended housing mountable across a door having a width defined between a hinge edge and an opening edge, said housing having a length between first and second ends sufficient to substantially span the width of the door;

a plurality of LEDs mounted to a PC board which is in turn fixed to said housing such that light generated by said plurality of LEDs is directed away from said door;

a push bar mounted for reciprocal movement relative to said housing, said push bar defining an opening for light generated by said plurality of LEDs;

a plate fixable to said push bar to cover said opening and define a push face for receiving a push force, said plate including at least one light transmissive portion in the form of letters or symbols comprising instructions for egress through the door;

wherein said housing is mountable to the door with the first end adjacent the opening edge of the door whether the door opens on the left or the right and said plate is fixable to said push bar such that said instructions for egress are illuminated and readable whether the door opens on the left or the right.

18. The reversible illuminated exit bar of claim 17, wherein said plurality of LEDs comprise a plurality of independently powered LED arrays, wherein a first of said plurality of independently powered LED arrays extends longitudinally behind substantially an entire length of said instructions for egress and at least a second of said independently powered LED arrays extends longitudinally behind only a portion of the entire length of said instructions for egress.

19. The reversible illuminated exit bar of claim 18, wherein said first and at least a second of said independently powered LED arrays are alternatively provided with power in response to a security status of the door.

20. The reversible illuminated exit bar of claim 17, further comprising door release means for releasing the door to permit egress, said door release means responsive to movement of said push bar toward said door in response to said push force.

* * * * *